US011826670B1

(12) United States Patent
Thai

(10) Patent No.: US 11,826,670 B1
(45) Date of Patent: Nov. 28, 2023

(54) MOVING BUBBLE TOY ANIMAL

(71) Applicant: Placo Bubbles Limited, Kowloon (HK)

(72) Inventor: Douglas Cong Thai, Kowloon (HK)

(73) Assignee: Placo Bubbles Limited, Hong Kong (HK)

( * ) Notice: Subject to any disclaimer, the term of this patent is extended or adjusted under 35 U.S.C. 154(b) by 0 days.

(21) Appl. No.: 18/360,592

(22) Filed: Jul. 27, 2023

(51) Int. Cl.
*A63H 33/28* (2006.01)
*A63H 11/10* (2006.01)

(52) U.S. Cl.
CPC ..... *A63H 33/28* (2013.01); *A63H 11/10* (2013.01)

(58) Field of Classification Search
CPC ..... A63H 33/28; A63H 11/10
See application file for complete search history.

(56) References Cited

U.S. PATENT DOCUMENTS 1,572,409 A * 2/1926 Oldham ..... A63H 33/28 446/24
1,733,478 A * 10/1929 Warham ..... A63H 33/28 446/16
2,618,892 A * 11/1952 Locks ..... A63H 33/28 446/268
2,624,974 A * 1/1953 Fisher ..... A63H 33/28 446/17
3,021,639 A * 2/1962 Allen ..... A63H 33/28 446/17
3,093,925 A * 6/1963 Greene ..... A63H 33/28 446/29
3,228,136 A * 1/1966 Rouse ..... A63H 33/28 446/16
4,299,049 A * 11/1981 Pimentel ..... A63H 33/28 446/15
4,556,392 A * 12/1985 Chang ..... A63H 33/28 446/16
4,576,582 A * 3/1986 Panzarella ..... A63H 33/28 446/16
4,804,346 A * 2/1989 Sheng ..... A63H 33/28 446/17
4,995,844 A * 2/1991 McNett ..... A63H 33/28 446/15

(Continued)

OTHER PUBLICATIONS

Willy TV, Wis Toyz Dinosaur Bubble Machine Toy Review, Nov. 8, 2019, YouTube Video, 5 page screenshots.*

*Primary Examiner* — Eugene L Kim
*Assistant Examiner* — Matthew B Stanczak
(74) *Attorney, Agent, or Firm* — Raymond Sun

(57) ABSTRACT

A bubble generating assembly has a housing shaped as an animal. The housing is made up of an upper housing section and a lower housing section that define an interior space, the upper housing having a front edge and a rear edge, a bubble opening positioned adjacent the front edge, and a bubble inlet positioned adjacent the rear edge. The lower housing section has a front piece with a transparent or open section, such that a bubble solution reservoir is positioned in the interior space adjacent the transparent or open section such that the contents of the bubble solution reservoir are visible from outside the housing. A bubble generator is positioned adjacent the upper housing section and generates bubbles that are emitted through the bubble opening. A plurality of legs is positioned below the lower housing section, and extend outside the width of the housing.

3 Claims, 12 Drawing Sheets

(56) References Cited

U.S. PATENT DOCUMENTS 5,071,387 A * 12/1991 Pottick ..... A63H 33/28 446/268
5,297,979 A * 3/1994 Amron ..... A63H 33/28 239/289
5,360,362 A * 11/1994 Cernansky ..... A63H 7/06 101/328
5,564,961 A * 10/1996 Spector ..... A63H 3/003 446/72
5,605,485 A * 2/1997 Spector ..... A63H 3/003 446/72
5,609,507 A * 3/1997 Spector ..... F41B 9/004 446/72
5,746,636 A * 5/1998 Cernansky ..... A63H 11/10 446/16
6,123,600 A * 9/2000 Yuen ..... A63H 11/205 446/280
6,142,845 A * 11/2000 Feldman ..... A63H 33/28 446/16
6,398,611 B1 * 6/2002 Lin ..... A63H 33/28 24/3.13
6,408,967 B1 * 6/2002 Huntsberger ..... B62K 9/00 239/289
6,572,427 B1 * 6/2003 Thai ..... A63H 33/28 446/176
6,616,498 B1 * 9/2003 Thai ..... A63H 33/28 446/15
7,140,943 B1 * 11/2006 Hawkins ..... A63H 3/005 206/457
9,566,534 B1 * 2/2017 Sufer ..... A63H 11/10
11,458,411 B1 * 10/2022 Thai ..... A63H 33/26
2002/0094744 A1 * 7/2002 Cheng ..... A63H 17/00 446/15
2003/0199221 A1 * 10/2003 Thai ..... A63H 33/28 446/15
2006/0084351 A1 * 4/2006 Wan ..... A63H 33/28 446/15
2007/0117491 A1 * 5/2007 Thai ..... A63H 33/28 446/15
2007/0270073 A1 * 11/2007 Thai ..... A63H 33/28 446/15
2007/0298674 A1 * 12/2007 Ivanic ..... A63H 33/28 446/15
2009/0149107 A1 * 6/2009 Thai ..... A63H 33/28 446/15
2011/0287685 A1 * 11/2011 Lam ..... A63H 33/28 446/15
2012/0208426 A1 * 8/2012 Kuo ..... A63H 33/28 446/15
2015/0343322 A1 * 12/2015 Beavers ..... B01F 35/32025 446/15
2018/0333862 A1 * 11/2018 Hayashi ..... A63H 13/005
2019/0192989 A1 * 6/2019 Kelly ..... A63H 33/28
2019/0314734 A1 * 10/2019 Cayton ..... A63H 33/28
2020/0061487 A1 * 2/2020 Thai ..... A63H 33/28
2020/0155957 A1 * 5/2020 Clayton ..... A63H 29/22
2021/0129040 A1 * 5/2021 Chan ..... A63H 33/28
2021/0260496 A1 * 8/2021 Yang ..... A63H 33/28
2021/0283516 A1 * 9/2021 Hayashi ..... A63H 11/10
2022/0054951 A1 * 2/2022 Bradley ..... A63H 33/28
2023/0082157 A1 * 3/2023 Wheeler ..... A63H 33/22 446/15
2023/0241527 A1 * 8/2023 Petrarca ..... A63H 33/28 446/16

* cited by examiner

FIG. 11A
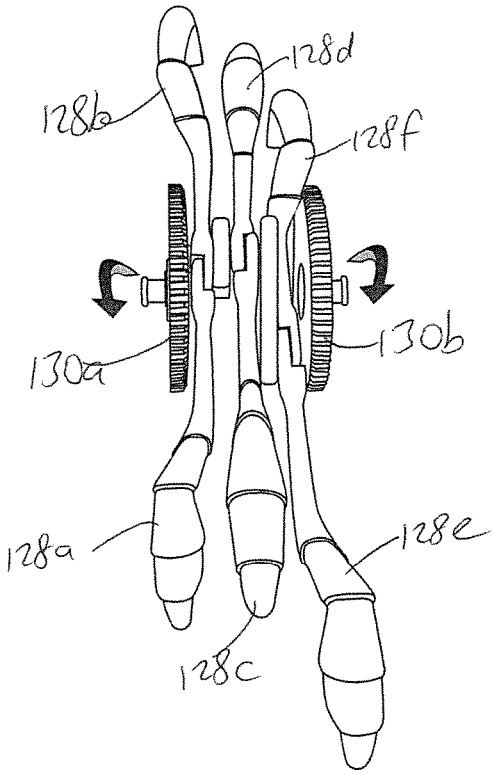
FIG. 11B
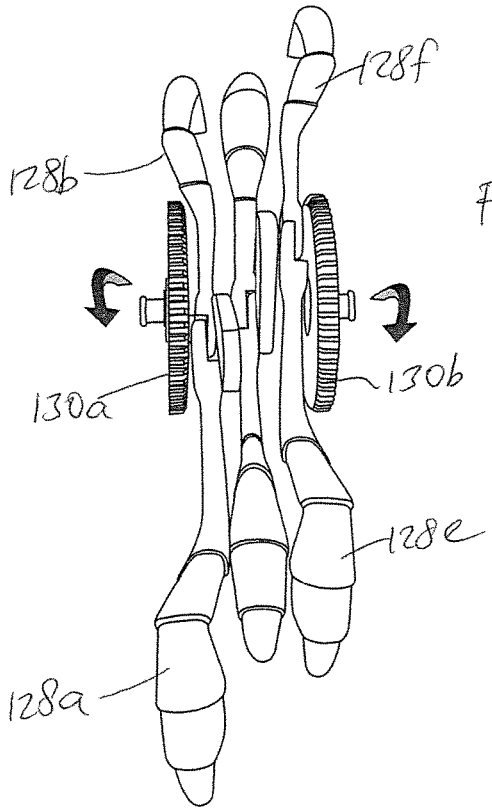
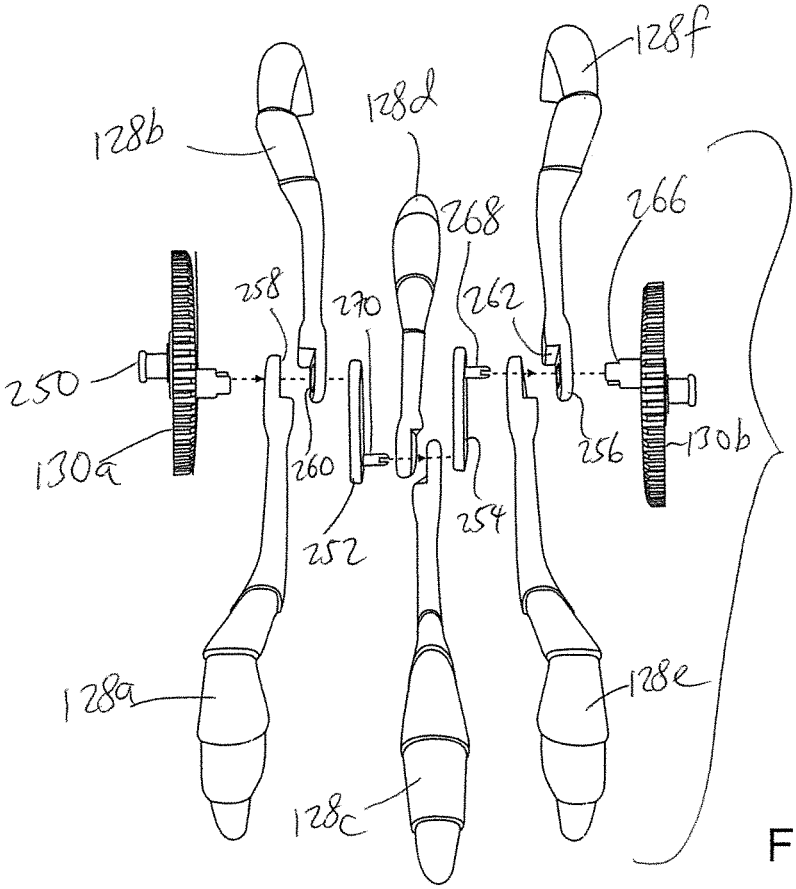
FIG.10

FIG.12A
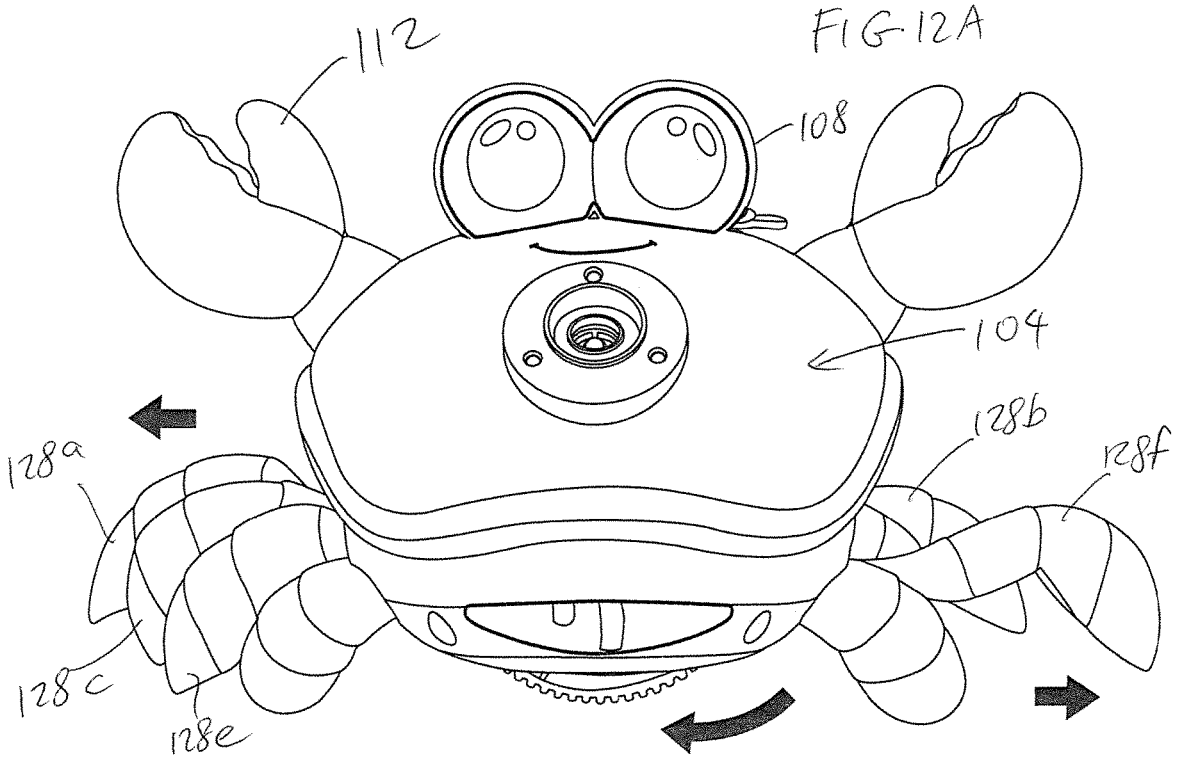
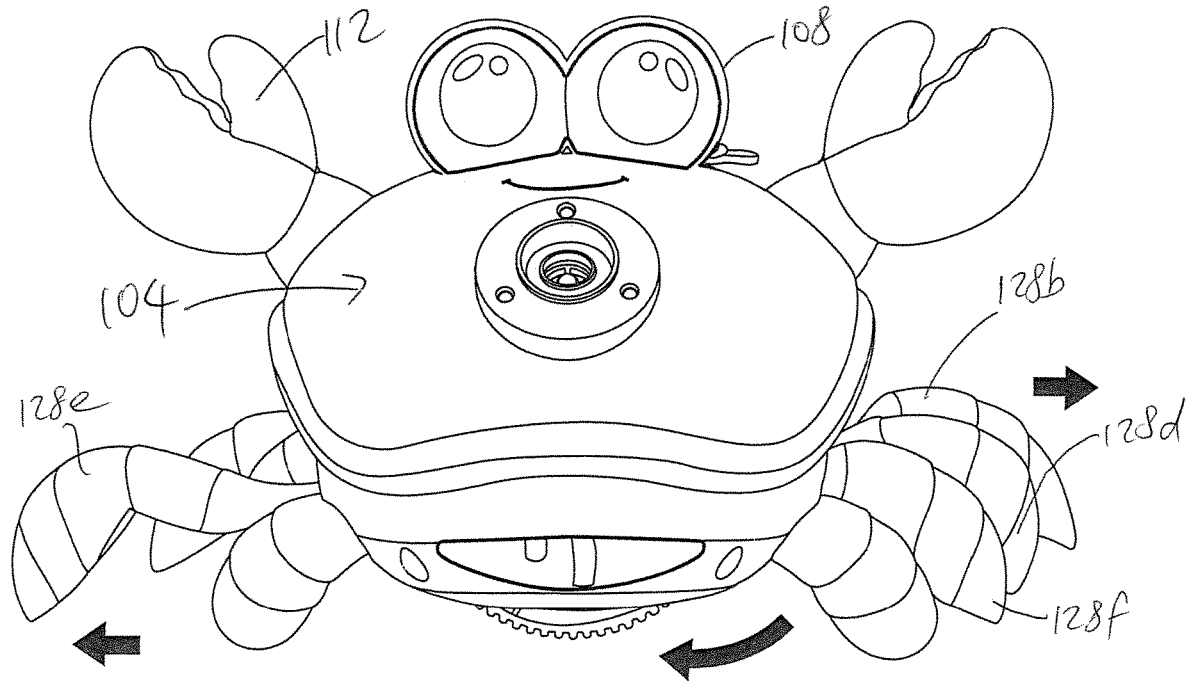
FIG.12B

MOVING BUBBLE TOY ANIMAL

BACKGROUND OF THE INVENTION

1. Field of the Invention

The present invention relates to bubble toys, and in particular, to a toy bubble generating toy which generates bubbles while moving along a surface.

3. Description of the Prior Art

Bubble producing toys are very popular among children who enjoy producing bubbles of different shapes and sizes. Many bubble producing toys have previously been provided. Perhaps the simplest example has a stick with a circular opening or ring at one end, resembling a wand. A bubble solution film is produced when the ring is dipped into a dish that holds bubble solution or bubble producing fluid (such as soap) and then removed therefrom. Bubbles are then formed by blowing carefully against the film. Such a toy requires dipping every time a bubble is to created, and the bubble solution must accompany the wand from one location to another.

Recently, the market has provided a number of different bubble generating assemblies that are capable of producing a plurality of bubbles. Examples of such assemblies are illustrated in U.S. Pat. Nos. 6,149,486 (Thai), 6,331,130 (Thai) and 6,200,184 (Rich et al.). The bubble rings in the bubble generating assemblies in U.S. Pat. Nos. 6,149,486 (Thai), 6,331,130 (Thai) and 6,200,184 (Rich et al.) need to be dipped into a dish that holds bubble solution to produce films of bubble solution across the rings. The motors in these assemblies are then actuated to generate air against the films to produce bubbles.

All of these aforementioned bubble generating assemblies require that one or more bubble rings be dipped into a dish of bubble solution. In particular, the child must initially pour bubble solution into the dish, then replenish the solution in the dish as the solution is being used up. After play has been completed, the child must then pour the remaining solution from the dish back into the original bubble solution container. Unfortunately, this continuous pouring and re-pouring of bubble solution from the bottle to the dish, and from the dish back to the bottle, often results in unintended spillage, which can be messy, dirty, and a waste of bubble solution.

More recent efforts to provide variety and entertainment with a bubble generating toy include a toy bubble volcano such as that illustrated in U.S. Pat. No. 11,458,411. Other examples include a bubble-generating gun such as those illustrated in U.S. Pat. Nos. 10,434,434 and 10,434,433, and animal-shaped bubble generating toys where bubbles are emitted from the mouth, such as that illustrated in U.S. Pat. No. 8,267,736. Despite the variety and entertainment provided by these efforts, there is still a need to provide bubble producing toys that offer greater entertainment and variety of features.

SUMMARY OF THE DISCLOSURE

It is an object of the present invention to provide a bubble generating toy which generates bubbles while it moves along a surface.

The objectives of the present invention are accomplished by providing a bubble generating assembly that has a housing shaped as an animal. The housing is made up of an upper housing section and a lower housing section that define an interior space, the upper housing having a front edge and a rear edge, a bubble opening positioned adjacent the front edge, and a bubble inlet positioned adjacent the rear edge. The lower housing section has a front piece with a transparent or open section, such that a bubble solution reservoir is positioned in the interior space adjacent the transparent or open section such that the contents of the bubble solution reservoir are visible from outside the housing. A tubing connects the bubble inlet with the bubble solution reservoir. A bubble generator is positioned adjacent the upper housing section and generates bubbles that are emitted through the bubble opening. A first motor is coupled to a pump assembly and the bubble generator to cause bubble solution to be delivered from the bubble solution reservoir to the bubble generator where a wiping bar in the bubble generator generates bubbles to be emitted through the bubble opening. At least one position sensor is provided on the housing to detect the position of the housing. A plurality of legs is positioned below the lower housing section, and extend outside the width of the housing. A second motor that is coupled to the plurality of legs for causing the plurality of legs to move. An on/off switch is coupled to the first and second motors for simultaneously turning on the first and second motors to cause bubbles to be generated and the plurality of legs to move.

BRIEF DESCRIPTION OF THE DRAWINGS

FIG. 10 is an exploded top view of the leg system for the assembly of FIG. 1.

FIGS. 11A and 11B are top views illustrating how the leg system of FIG. 10 operates.

FIGS. 12A and 128 are front views illustrating how the leg system of FIG. 10 operates.

DETAILED DESCRIPTION OF THE PREFERRED EMBODIMENTS

Figure 1:
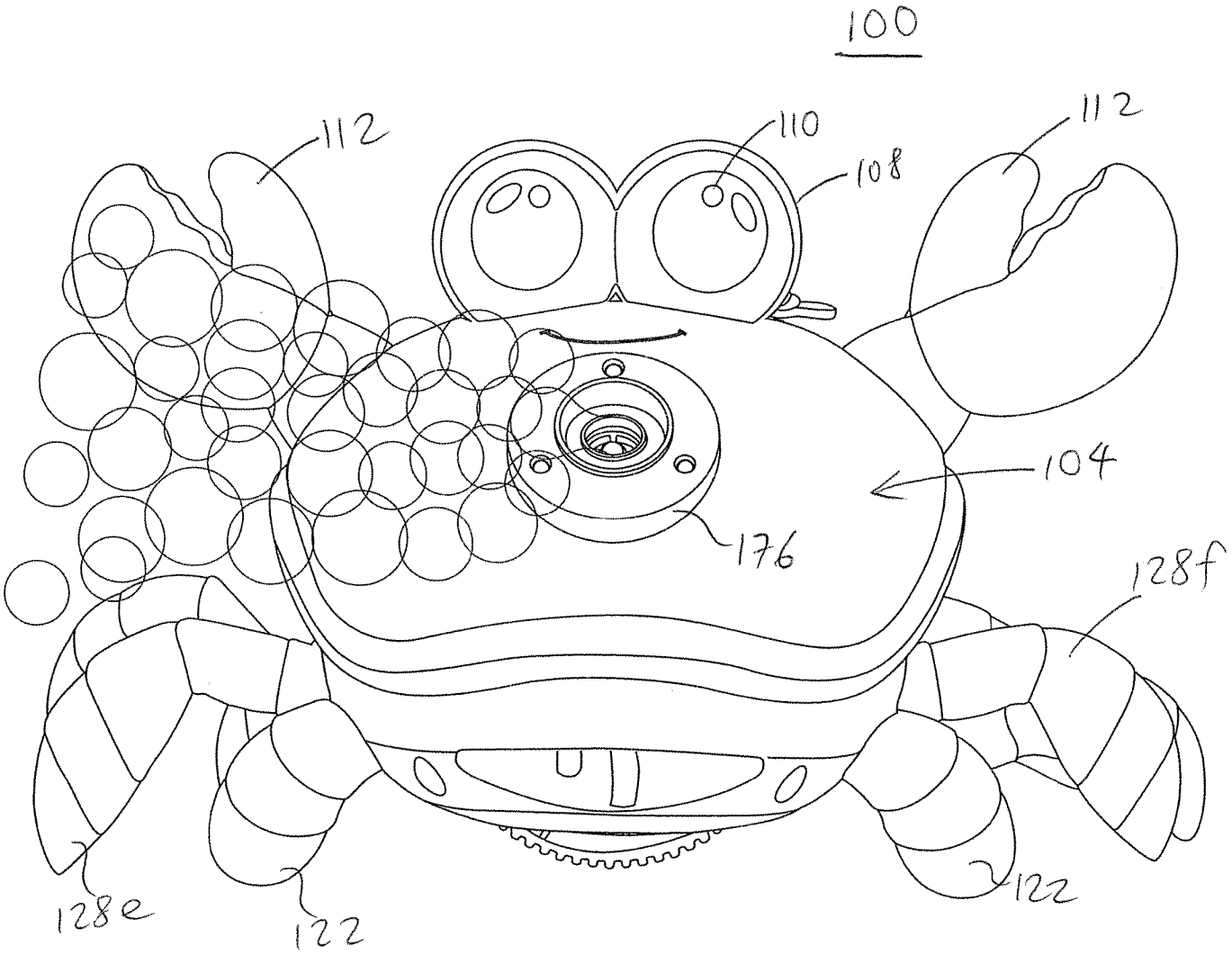
FIG. 1 is a front perspective view of an animal-shaped bubble generating assembly according to one embodiment of the present invention.
Figure 2:
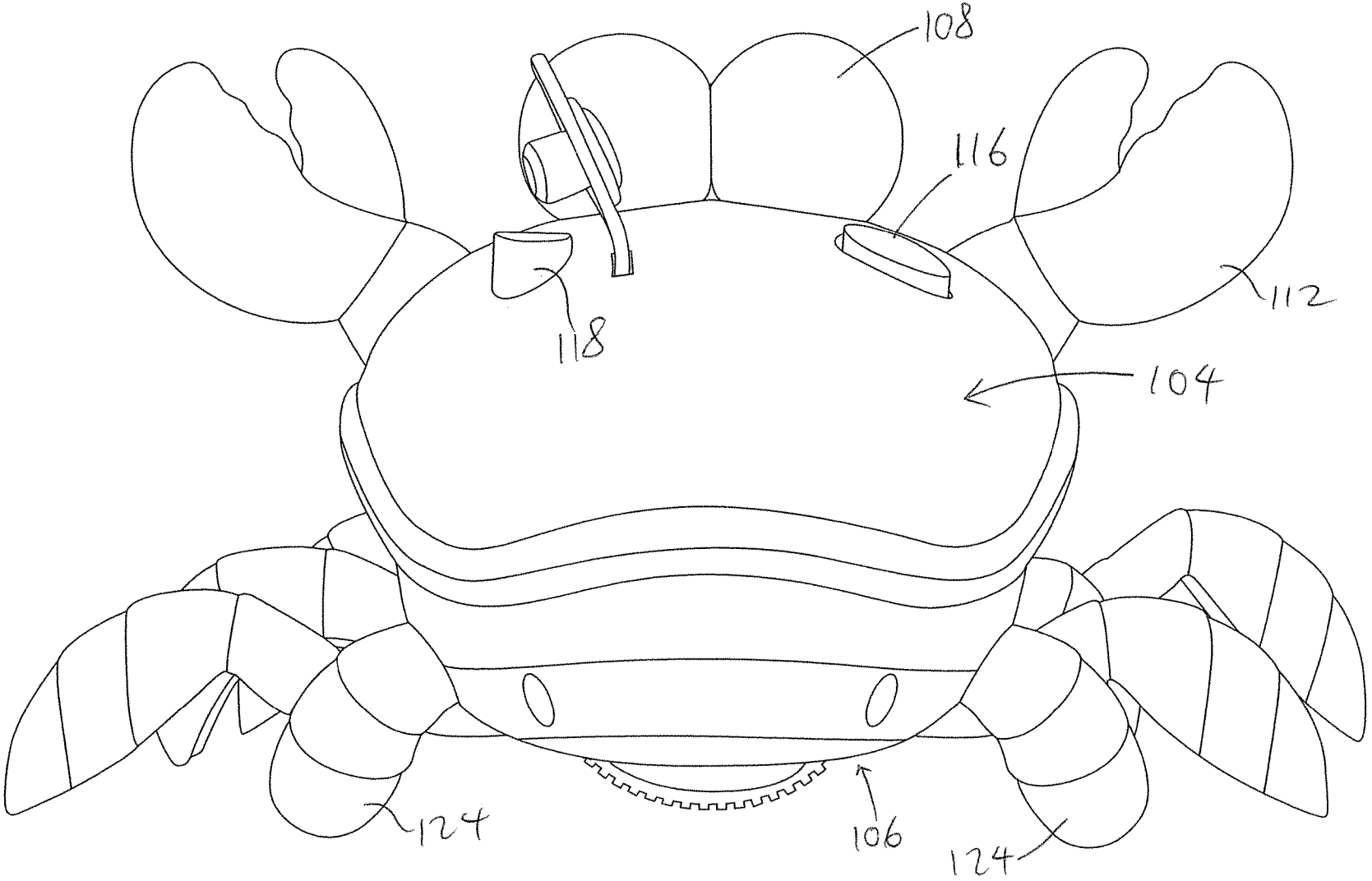
FIG. 2 is a rear perspective view of the assembly of FIG. 1.
Figure 3:
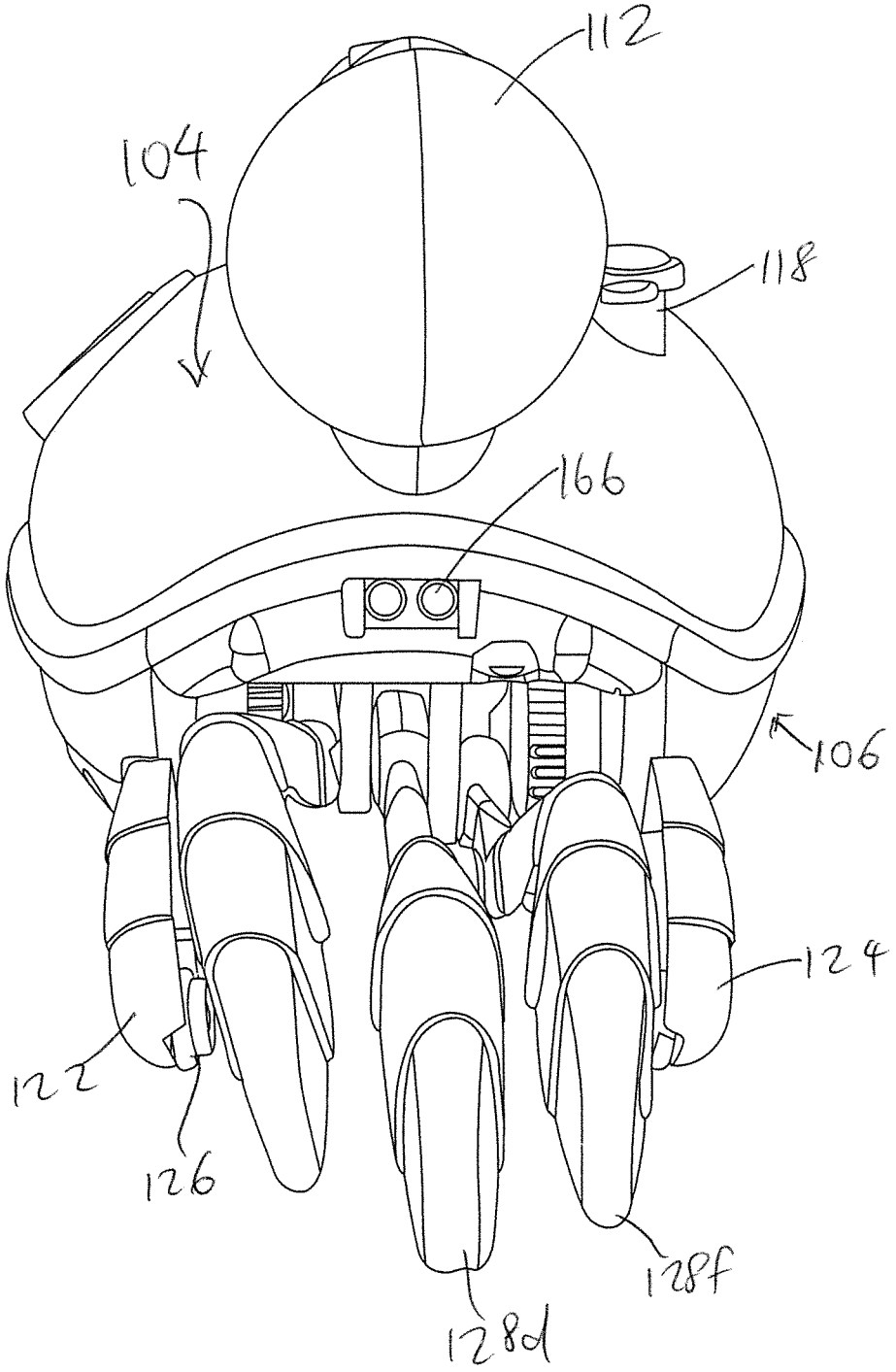
FIG. 3 is a left side view of the assembly of FIG. 1, the right side view being symmetrical.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

FIGS. 1-11B illustrate one embodiment of a bubble generating assembly 100 according to the present invention. The assembly 100 has a housing that is shaped like an animal. For example, the housing in FIGS. 1-11B is shaped like a crab. The housing can also be shaped like any other animal that has legs that can be moved along or across a flat surface. The housing includes an upper housing section 104 and a lower housing section 106 that enclose and retain the components that make is up the electrical control system, the bubble generating system and the leg system.

The upper housing section 104 is shaped as the upper shell of a crab, with a pair of eyes 108 that contain light bulbs 110 that are adapted to light up when actuated. Two stationary claws 112 are provided on the upper housing section 104, and a bubble opening 114 (see FIG. 4) is provided at the front of the upper housing section 104 (in front of the eyes 108) through which bubbles can be emitted. An on/off switch 116 and a bubble inlet 118 are provided at the rear (behind the eyes 108) of the upper housing section 104.

The lower housing section 106 functions as a base for receiving or holding components of the electrical control system, the bubble generating system and the leg system. The lower housing section 106 also holds the reservoir 120, and has two front stationary legs 122 and two rear stationary legs 124 that extend from the base 132. Each stationary leg 122, 124 has a roller or wheel 126 to help facilitate movement of the housing along a flat surface. A leg system is positioned below the lower housing section 106 and has a set of six moving legs 128*a*-128*f* that are coupled together and sandwiched by two external wheels 130*a* and 130*b*.

Figure 4:
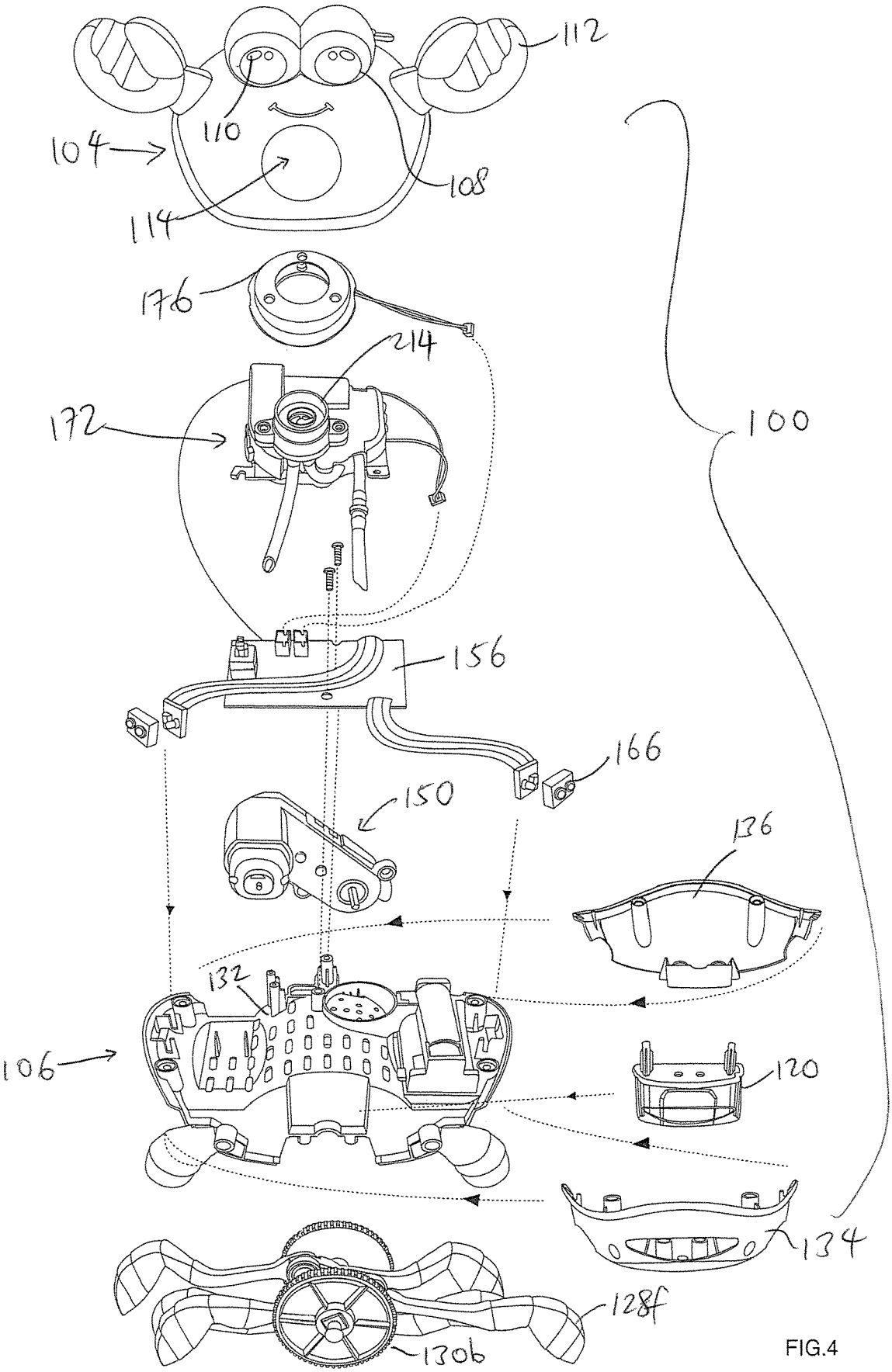
FIG. 4 is an exploded top perspective view of most of the internal components of the assembly of FIG. 1.
Figure 5:
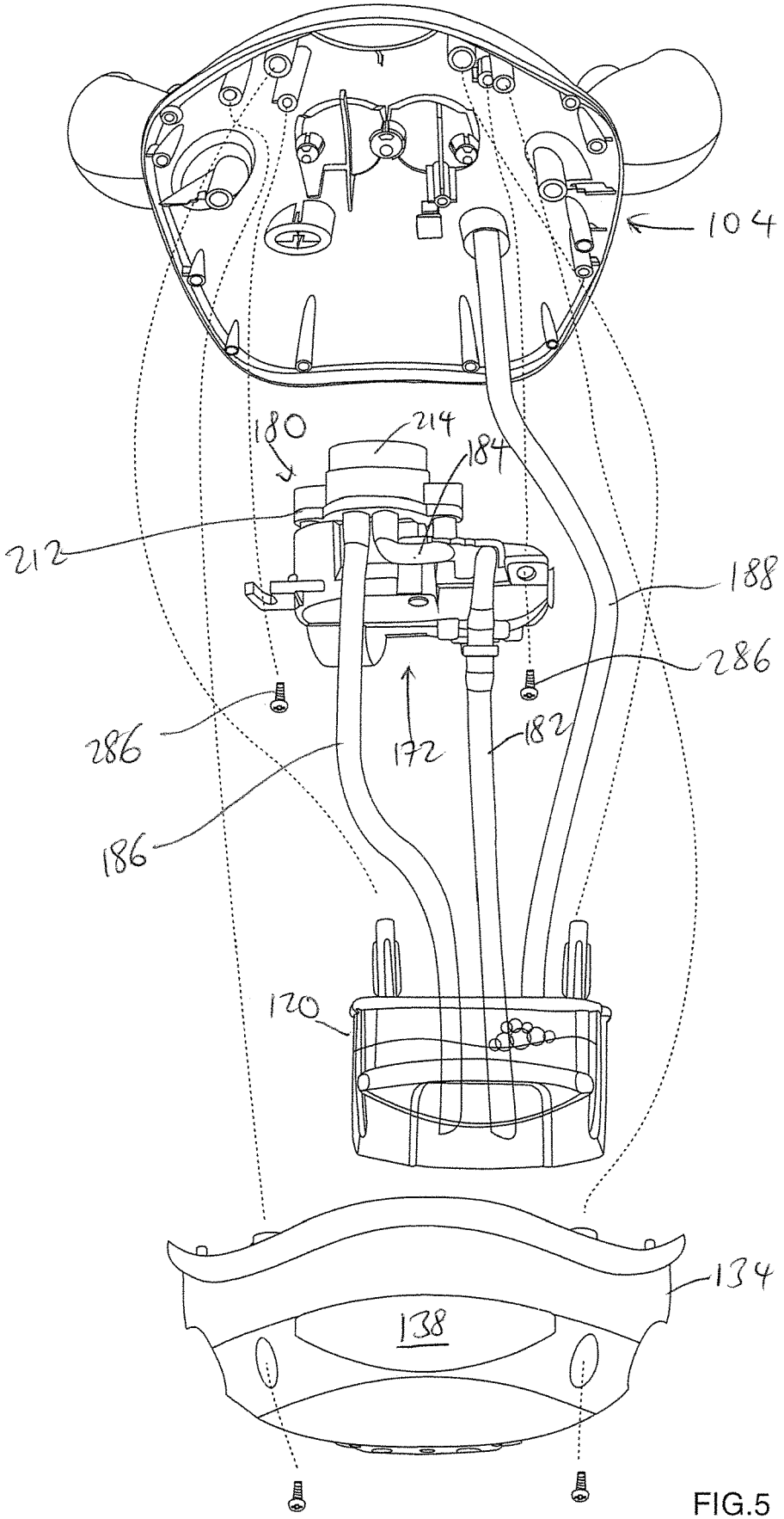
FIG. 5 is an exploded bottom perspective view showing the components that make up the bubble generating system of the assembly of FIG. 1.
Figure 6:
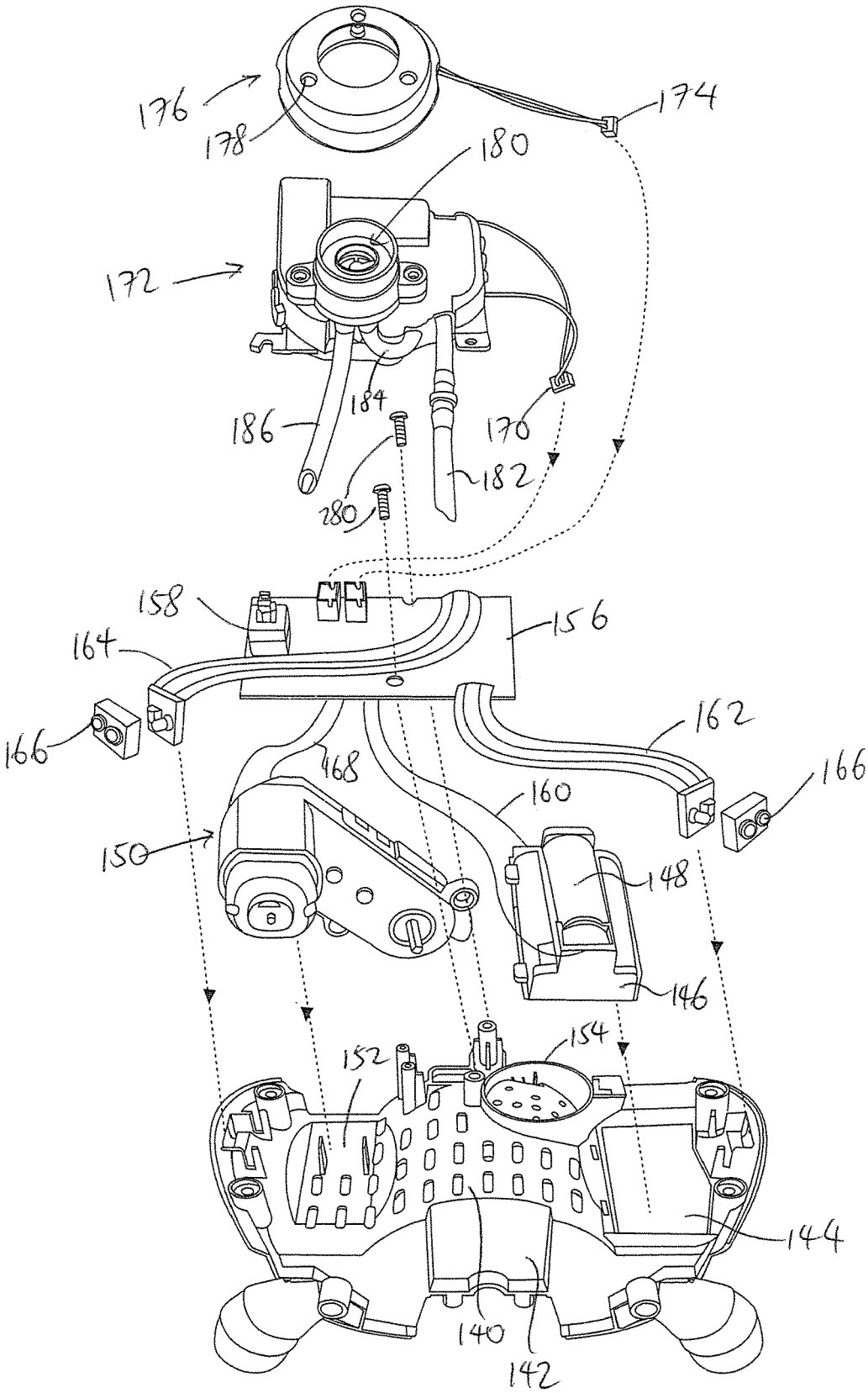
FIG. 6 is an exploded top perspective view of the components that make up the bubble generating system of the assembly of FIG. 1.
Figure 9:
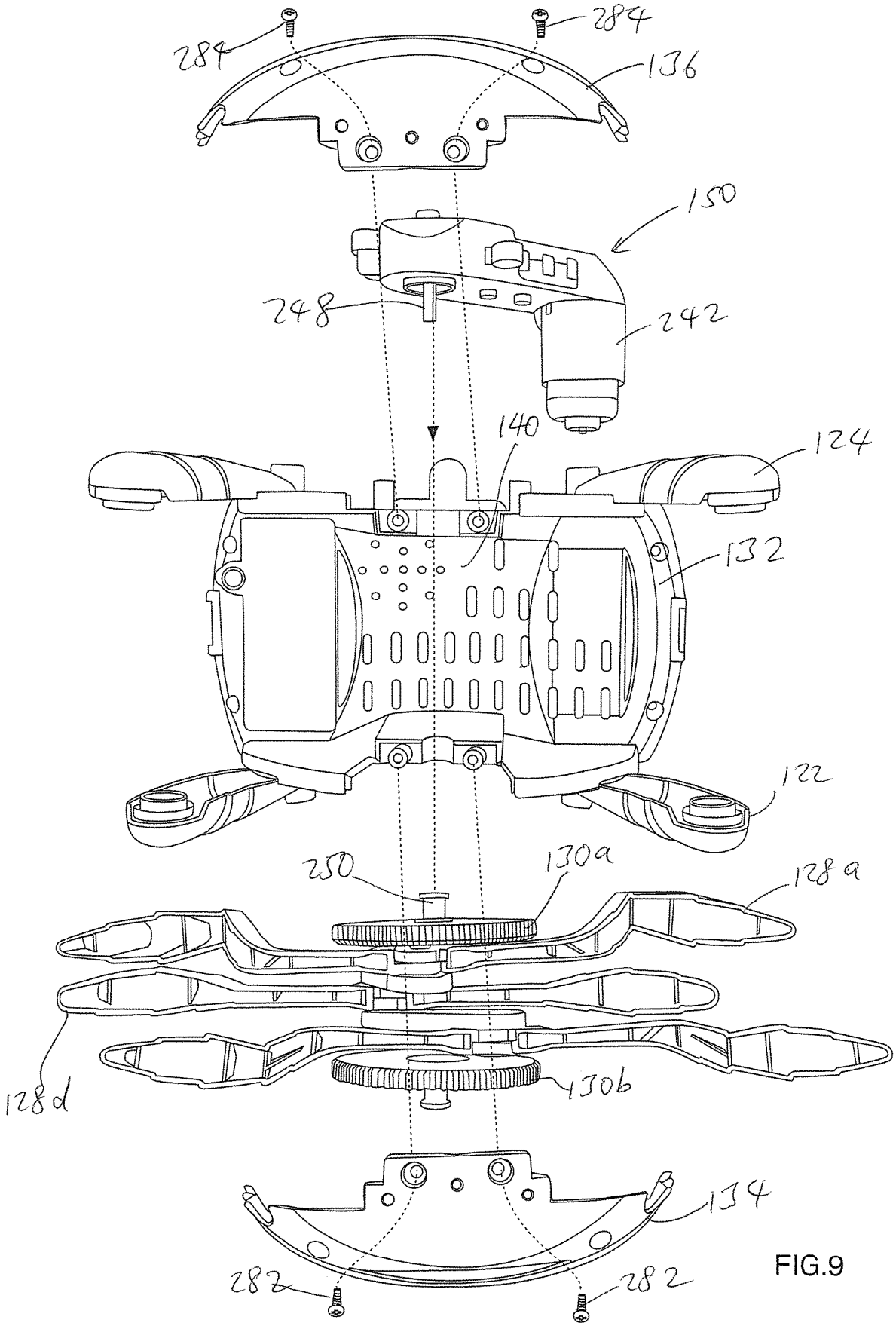
FIG. 9 is an exploded perspective view showing the connection of the second motor housing to the leg system for the assembly of FIG. 1.

Referring mostly to FIGS. 4, 6 and 9, the lower housing section 106 is made up of the base 132, a front piece 134, and a rear piece 136. The front piece 134 has a transparent or open section 138 (see FIG. 5) positioned adjacent the reservoir 120 so that the contents of the reservoir 120 are visible from the outside. The base 132 has an arched shape with a central section 140 that is vertically higher than the other sections of the base 132. The reservoir 120 is seated on a front platform 142 of the base 132 at the front of the arched central section 140. A battery compartment 146 (which holds a battery 148) is seated on a platform 144 of the base 132 that is to the left of the arched central section 140, and a motor housing 242 of a second motor housing 150 is seated in a compartment 152 of the base 132 that is provided on the right of the arched central section 140. A circular housing 154 is provided at the rear of the arched central section 140, and a circuit board 156 is adapted to be secured on the top of the circular housing 154 by screws 280.

The circuit board 156 can be a conventional PCB (printed circuit board) that has a processor (not shown), and a switch actuator 158 that is adapted to be releasably actuated by the on/off switch 116. Wires 160 connect the circuit board 156 with the battery compartment 146, wires 162 and 164 connect the circuit board 156 with left and right sensors 166, and wires 168 connect the circuit board 156 with the second motor housing 150. A plug 170 and accompanying wires connect the circuit board 156 with the first motor housing 172, and another plug 174 and accompanying wires connect the circuit board 156 with the bubble cap 176 of the bubble generator 180 to provide power to light up the light bulbs 178 in the bubble cap 176. When the on/off switch 116 is turned on, the power from the battery 148 is provided to simultaneously power the two motors 194 and 244 so that the bubble generator 180 will generate bubbles, and the legs 128*a*-128*f* are made to move so as to cause the bubble generating assembly 100 to move along a flat surface. The connected light bulbs 110 and 178 will also be powered to either turn on, or to flash.

As best shown in FIG. 9, the front piece 134 and the rear piece 136 are secured to the base 132 via screws 282 and 284, respectively. The legs 128*a*-128*f* of the leg system are positioned below the base 132.

The bubble generating system is best illustrated in FIGS. 5-7C, and includes the first motor housing 172 which is secured to the underside of the upper housing section 104 via screws 286, the bubble generator 180 which is secured on top of the first motor housing 172 (via screws 288), the reservoir 120, and related tubings.

Figure 7B:
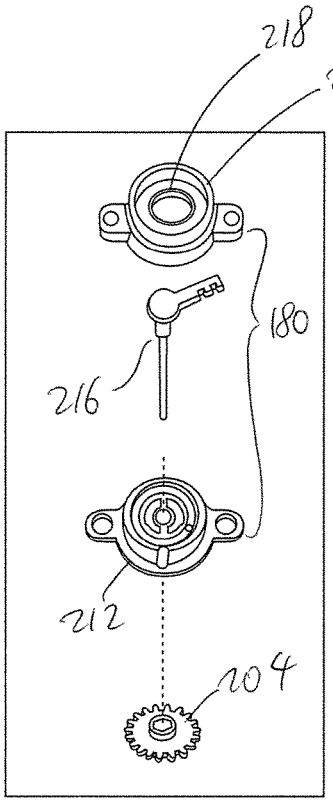
FIG. 7B is an exploded perspective view of the components in the bubble generator.
Figure 7C:
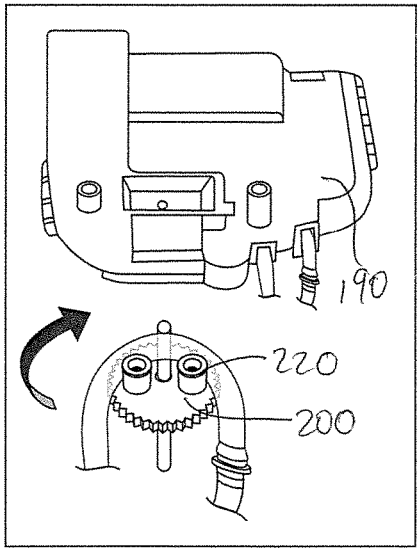
FIG. 7C is an exploded view illustrating how the bubble solution tubing inside the first motor assembly is pressured to create the pumping action.
Figure 7A:
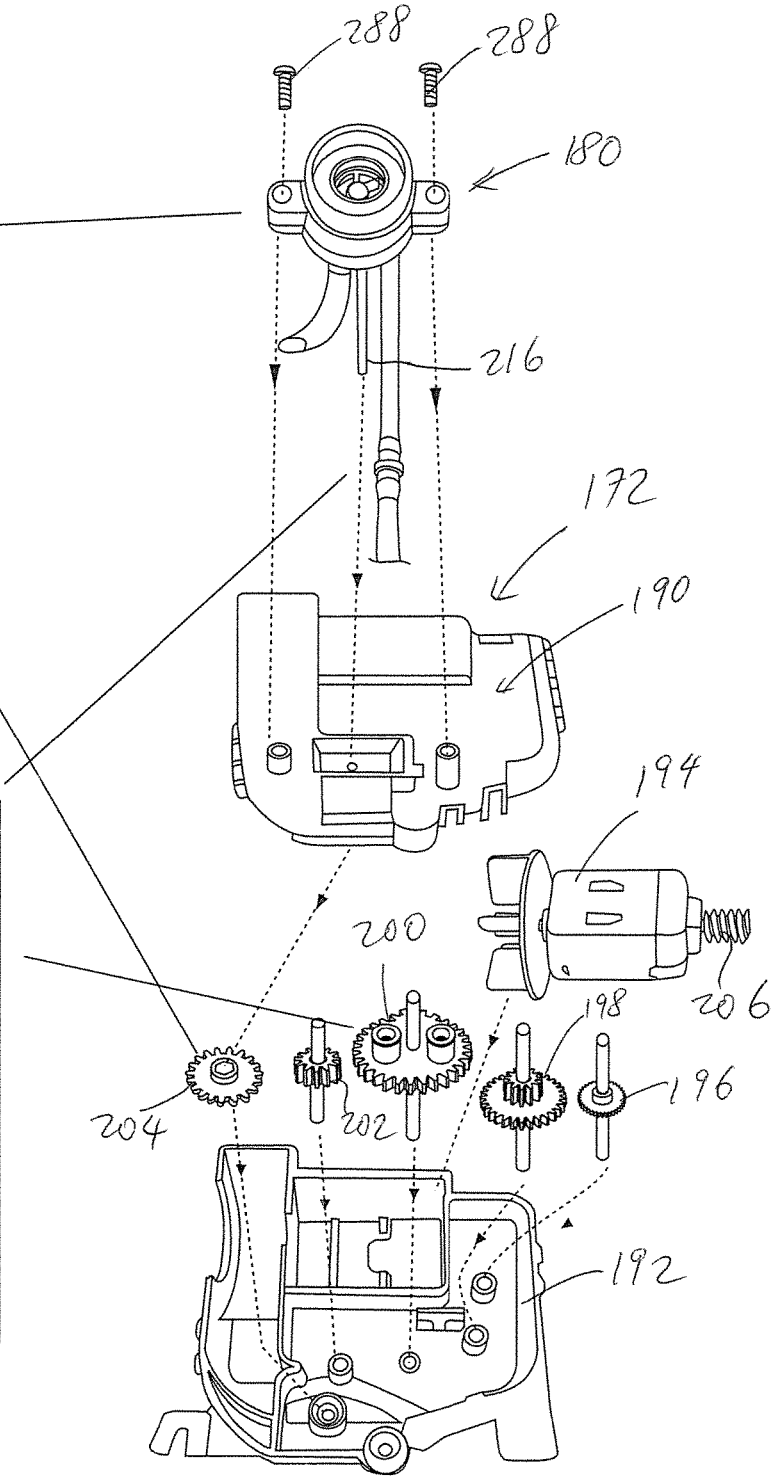
FIG. 7A is an exploded perspective view showing the first motor assembly and the bubble generator.

As best shown in FIGS. 7A and 7C, the first motor housing 172 has an upper housing 190 and a lower housing 192 that define an interior space. A first motor 194 is seated inside a compartment inside the lower housing 192, and a gear system is seated inside the lower housing 192. The gear system includes a motor gear 196, a first coupling gear 198, a tubing gear 200, a second coupling gear 202, and a wiping gear 204. Each gear is secured for rotation to the lower housing 192 via a shaft. The first motor 194 has a gear 206 that drives the motor gear 196, which in turn drives the tubing gear 200 (via the first coupling gear 198), which in turn drives the wiping gear 204 (via the second coupling gear 202).

A first tubing 182 has an intake section that connects the interior of the reservoir 120 and the pump compartment (see FIG. 7C) of the first motor housing 172. The pump system includes the tubing gear 200 and the first tubing 182. The tubing gear 200 has two spaced-apart projections 220, and the first tubing 182 is adapted to travel around the two projections 220 in a manner such that the first tubing 182 is carried on the tubing gear 200. When the tubing gear 200 rotates, the projections 220 press the tubing 182 to create pressure that causes the bubble solution inside the tubing 182 to flow or advance. The bubble solution that is pumped from the reservoir 120 to the pump compartment is then advanced along a delivery section 184 of the first tubing 182 to the bubble generator 180. A second tubing 186 then extends between the bubble generator 180 and the reservoir 120 to deliver unused bubble solution back to the reservoir 120. A third tubing 188 extends from the bubble inlet 118 (which is positioned adjacent the rear side of the assembly 100) to the reservoir 120 (which is positioned adjacent the front side of the assembly 100) to deliver new bubble solution from the user to the reservoir 120.

As shown in FIG. 7B, the bubble generator 180 has a bubble wand secured for rotation inside the bubble generator housing that includes a base 212 and a window 214 secured to the base 212. The base 212 is secured to the top of upper housing 190. The window 214 is a circular piece that defines a bubble-generating opening 218. As best shown in FIG. 5, the delivery section 184 of the first tubing 182 extends into the base 212, and the second tubing 186 extends from the base 212. The bubble solution that has been delivered from the delivery section 184 will pass through the space defined between the base 212 and the window 214. A wiping bar 216 functions as a bubble wand, and is positioned inside the space defined between the base 212 and the window 214. The wiping bar 216 is connected to the wiping gear 204 so that rotation of the wiping gear 204 will cause the wiping bar 216 to pivot or rotate. A film of bubble solution is formed by wiping the wiping bar 216 across the bubble generating opening 218 in the window 214. The bubble cap 176 is secured over the window 214 and fitted in the opening 114. The bubble cap 176 has a central opening that is aligned with the bubble generating opening 218 to allow generated bubbles to be emitted therethrough.

Thus, when the first motor 194 is turned on, the gear system will cause the tubing gear 200 and the wiping gear 204 to rotate, thereby causing the pump system to draw bubble solution from the reservoir 120 to the bubble generator 180 via the first motor housing 172. The pump system will continue to return bubble solution to the reservoir 120 via the second tubing 186.

Figure 8:
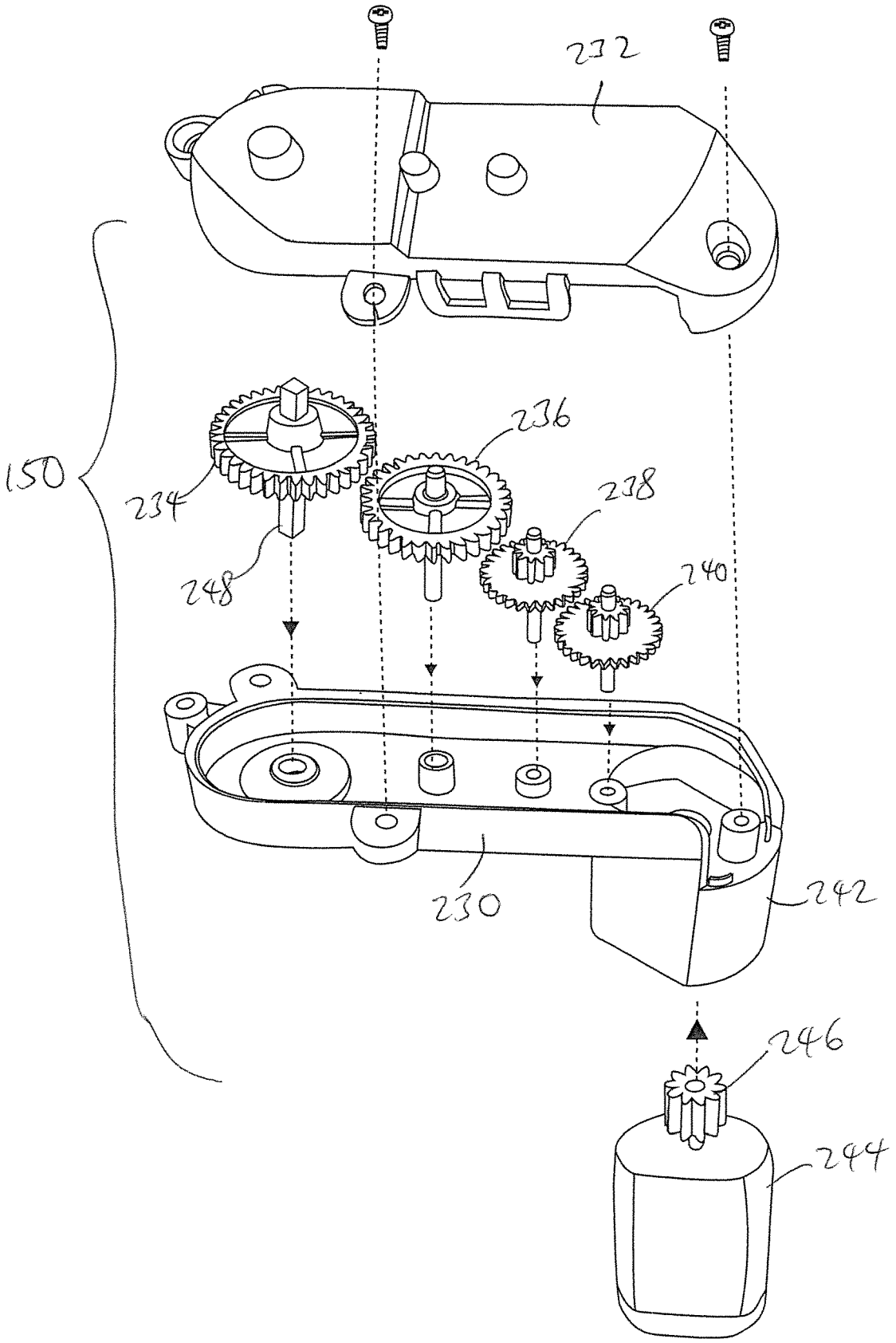
FIG. 8 is an exploded perspective view of the second motor housing of the assembly of FIG. 1.

FIG. 8 illustrates the second motor housing 150, which includes an inner piece 230 and an outer piece 232 that define an inner space, and with a plurality of gears 234, 236, 238 and 240 housed for rotation inside the inner space. One end of the inner piece 230 has a motor housing 242 which houses a second motor 244. The second motor 244 has a gear 246 which drives the gear 240, which in turn causes the gears 238 and 236 to drive the leg gear 234. The leg gear 234 has a shaft 248 which extends outside the inner piece 230 to engage a hub 250 of the leg system (see FIG. 9).

FIGS. 9-11B illustrate the leg system and how the second motor housing 150 is operably coupled to the leg system. FIG. 9 shows a bottom view of the base 132, and as also shown in FIG. 6, the motor housing 242 of the second motor housing 150 is seated in a compartment 152 of the base 132, and the combined inner piece 230/outer piece 232 extends downwardly at an angle along the rear of the base 132 such that the shaft 248 extends below the arched central section 140 to engage a hub 250 of the first wheel 130*a*. The legs 128*a*-128*f* are positioned below the base 132, and the wheels 130*a* and 130*b* are positioned below the arched central section 140.

Referring to FIGS. 11A-11C, the leg system has six legs 128*a*-128*f* arranged in left-right pairs so that the arrangement is of three sets of left legs and three sets of right legs. Each pair of left-right legs is adapted to move as a unit. Each pair of legs 128*a*/128*b*, 128*c*/128*d* and 128*e*/128*f* also extends outside the width of the housing.

A first coupling arm 252 couples one pair of legs 128*a*/128*b* with the adjacent pair of legs 128*c*/128*d*, and a second coupling arm 254 couples the pair of legs 128*c*/128*d* with the adjacent pair of legs 128*e*/128*f*. The first wheel 130*a* couples the pair of legs 128*a*/128*b* such that this pair of legs is sandwiched by the first wheel 130*a* and the first coupling arm 252. Similarly, a second wheel 130*b* couples the pair of legs 128*e*/128*f* such that this pair of legs is sandwiched by the second wheel 130*b* and the second coupling arm 254.

Each leg 128*a*-128*f* has a recessed inner end 256 that has a flat surface 258, a stepped surface 262 perpendicular to the flat surface 258, and a hole 260 extending though the flat surface 258. The inner ends 256 of the legs 128*a* and 128*b* are adapted to be fitted together with their respective flat surfaces 258 fitted against each other, in a manner such that their respective holes 260 are aligned to allow an inner shaft 264 from the first wheel 130*a* to extend through the holes 260 so as to rotatably couple the first wheel 130*a* to the combined legs 128*a*/128*b* and a first end of the first coupling arm 252. Similarly, the inner ends 256 of the legs 128*e* and 128*f* are adapted to be fitted together with their respective flat surfaces 258 fitted against each other, in a manner such that their respective holes 260 are aligned to allow an inner shaft 266 from the second wheel 130*b* to extend through the holes 260 so as to rotatably couple the second wheel 130*b* to the combined legs 128*e*/128*f* and a shaft 268 at a first end of the second coupling arm 254. More specifically, the shaft 268 can extend through the holes 260 in the legs 128*e* and 128*f* and into a bore (not shown) in the shaft 266 of the second wheel 130*b*. In addition, the inner ends 256 of the legs 128*c* and 128*d* are adapted to be fitted together with their respective flat surfaces 258 fitted against each other, in a manner such that their respective holes 260 are aligned to allow a shaft 270 from the second end of the first coupling arm 252 to extend through the holes 260 and connect with the second end of the second coupling arm 254, so as to rotatably couple the legs 128*c*/128*d* with the other two sets of legs 128*a*/128*b* and 128*e*/128*f*.

FIGS. 11A and 11B illustrate the fully-assembled leg system. The arrangement shown in FIG. 10 allows the rotation of the first wheel 130*a* (via rotation from the shaft 248 of the second motor housing 150) to cause the inner ends 256 of the three sets of legs to rotate with respect to the axes defined by the shafts 264, 266, 268 and 270, which in turn causes the assembly 100 to experience sideway movement. In this regard, the coupling arms 252 and 254 create the rotational movement that translates into sideways or lateral movement of the pairs of legs. The motion sensors 166 detect when the assembly 100 approaches a wall or object, which causes the second motor 244 to rotate in the opposite direction so that the leg system drives the assembly 100 in the opposite sideway direction.

More specifically, as shown when comparing FIGS. 11A and 11B, rotation of the wheels 130*a* and 139*b* will cause the leg pair 128*a*/128*b* to move from left to right, and cause the leg pair 128*e*/128*f* to move from right to left. This left-to-right and right-to-left movement for these two pairs of legs 128*a*/128*b* and 128*e*/128*f* is also shown by the arrows in FIGS. 12A and 12B. This left-to-right and right-to-left movement also translates into in-and-out movement of the legs 128*a*-128*f*.

Figure 13A:
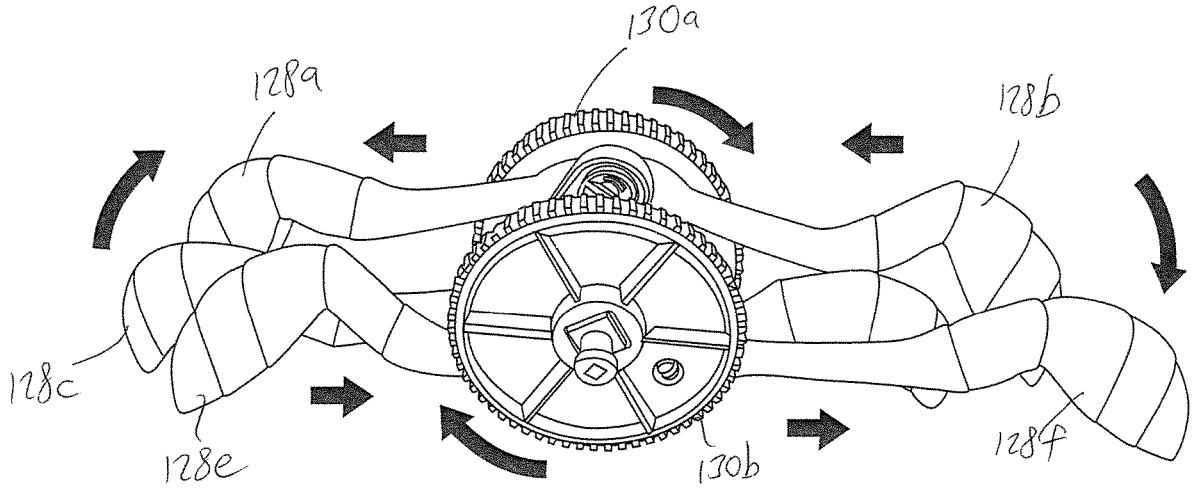
FIGS. 13A-13C are front views illustrating how the leg system of FIG. 10 operates.
Figure 13B:
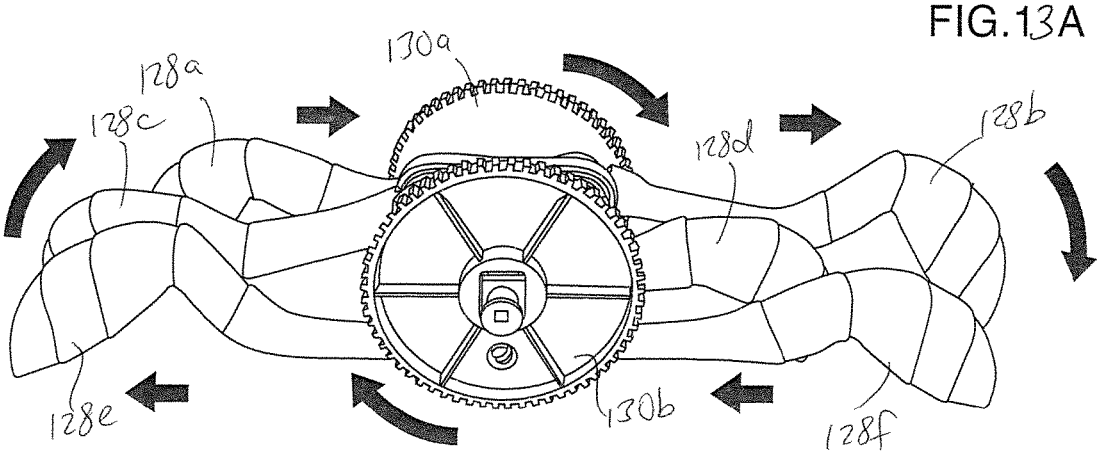
Figure 13C:
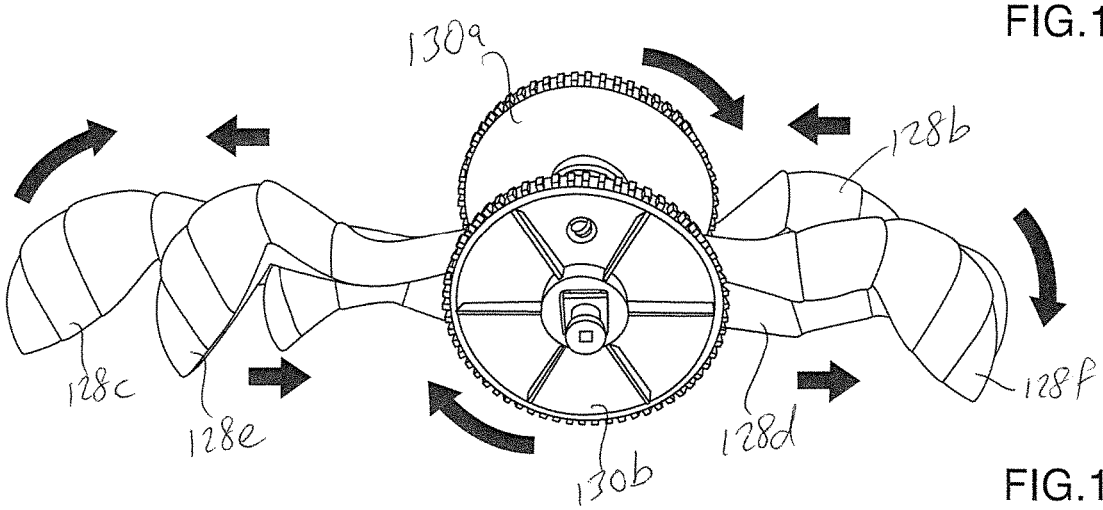

The arrows in FIGS. 13A-13C also illustrate the left-to-right and right-to-left movement for the three pairs of legs 128*a*/128*b*, 128*c*/128*d* and 128*e*/128*f*, and additionally show the up-down movement of the middle pair of legs 128*c*/128*d*. This up-down movement is actually a clockwise motion that incorporates up and down components. When the legs 128*a*-128*f* are rotated in the opposite direction, the clockwise motion becomes a counter-clockwise motion. It is the rotation of the wheels 130*a* and 130*b* that causes the clockwise and counter-clockwise motion of the legs 128*a*-128*f*, which then translates into both up-down and sideways (left-to-right, right-to-left) movement.

In operation, when the on/off switch 116 is turned on, the two motors 194 and 244 are turned on at the same time. The first motor 194 will drive the gear system in the first motor housing 172 which causes the pump system to deliver bubble solution from the reservoir 120 to the bubble generator 180 to generate bubbles that are emitted through the window 214. It is important to note that this first motor 194 simultaneously controls both the wiping bar 216 (via the wiping gear 204) and the pumping action (FIG. 7C—via the tubing gear 200), both actions (wiping and pump) which are required for generating bubbles. Meanwhile, the second motor 244 will drive the gear system in the second motor housing 150 which causes the leg system to move the assembly 100 along a flat surface. While the present disclosure illustrates the use of separate motors to control the bubble generating and movement functions, it is also possible to provide a single motor to control both operations. In addition, the motion sensors 166 allow the assembly 100 to avoid collision with other objects.

Thus, the present invention provides a bubble generating assembly 100 that has multiple entertainment features. It can automatically generate bubbles, and it can move while bubbles are being generated. If deployed in a large open space, the assembly 100 can produce a long stream or trail of bubbles that follow the moving assembly 100. In addition, the flashing light bulbs can further enhance the entertainment value of the assembly 100.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A bubble generating assembly comprising:

a housing shaped as an animal and having a width, an upper housing section and a lower housing section that define an interior space, the upper housing having a front edge and a rear edge, a bubble opening positioned adjacent the front edge, and a bubble inlet positioned adjacent the rear edge, and wherein the lower housing section has a front piece with a transparent or open section;

a bubble solution reservoir positioned in the interior space adjacent the transparent or open section such that the contents of the bubble solution reservoir are visible from outside the housing, and wherein a tubing connects the bubble inlet with the bubble solution reservoir;

a bubble generator positioned adjacent the upper housing section and generating bubbles that are emitted through the bubble opening;

a first motor that is coupled to a pump assembly and the bubble generator to cause bubble solution to be delivered from the bubble solution reservoir to the bubble generator where a wiping bar in the bubble generator generates bubbles to be emitted through the bubble opening;

at least one position sensor provided on the housing to detect the position of the housing;

a plurality of legs positioned below the lower housing section, and extending outside the width of the housing;

a second motor that is coupled to the plurality of legs for causing the plurality of legs to move; and an on/off switch coupled to the first and second motors for simultaneously turning on the first and second motors to cause bubbles to be generated and the plurality of legs to move;

wherein the plurality of legs have an up and down, in and out, and clockwise and counterclockwise movement, wherein the movement is reversed when the at least one position sensor senses that the assembly is approaching an object; and wherein the plurality of legs includes at least two pairs of legs, wherein each pair of legs includes a left leg and a right leg that are rotatably joined together, and further including at least one wheel that is rotatably coupled to each of the at least two pairs of legs and the second motor so translate driving motion from the second motor to the at least two pairs of legs.

2. The assembly of claim 1, wherein the animal is a crab or an octopus.

3. The assembly of claim 1, wherein the lower housing section has an arched section, and the at least one wheel is positioned under the arched section.

* * * * *